US006520863B2

(12) United States Patent
Porper

(10) Patent No.: US 6,520,863 B2
(45) Date of Patent: Feb. 18, 2003

(54) BILLIARDS CHALK ASSEMBLY

(75) Inventor: Joseph Porper, Chatsworth, CA (US)

(73) Assignee: Creative Inventions, Chatsworth, CA (US)

( * ) Notice: Subject to any disclaimer, the term of this patent is extended or adjusted under 35 U.S.C. 154(b) by 30 days.

(21) Appl. No.: 09/818,317

(22) Filed: Mar. 27, 2001

(65) Prior Publication Data

US 2002/0142853 A1 Oct. 3, 2002

(51) Int. Cl.[7] ..... A63D 15/16; A63D 15/00; A45F 5/00

(52) U.S. Cl. ..... 473/35; 473/36; 473/39; 224/183; 224/271

(58) Field of Search ..... 473/35–39; 224/918, 224/919, 271, 183, 904

(56) References Cited

U.S. PATENT DOCUMENTS

D252,422 S * 7/1979 Gillenwater ..... D3/221
D296,156 S * 6/1988 Deany et al. ..... D3/221
D301,286 S * 5/1989 Hird ..... D21/794
4,953,770 A * 9/1990 Bond ..... 473/36
5,025,966 A * 6/1991 Potter ..... 224/183
5,046,728 A * 9/1991 Haddock ..... 473/36
5,328,411 A * 7/1994 Thornton II ..... 473/36
5,375,749 A * 12/1994 Oliva ..... 224/242
5,382,196 A * 1/1995 Lodrick ..... 473/38
D364,910 S * 12/1995 Shovek ..... D21/782
5,597,102 A * 1/1997 Saarikko et al. ..... 224/191
5,850,954 A * 12/1998 Dong-Joo ..... 224/197
D443,329 S * 6/2001 Helmreich ..... D21/796

* cited by examiner

*Primary Examiner*—Paul T. Sewell
*Assistant Examiner*—Mitra Aryanpour
(74) *Attorney, Agent, or Firm*—Kelly Bauersfeld Lowry & Kelley, LLP

(57) ABSTRACT

A billiards chalk assembly includes a clip, a billiards chalk holder releasably attached to the clip, and billiards chalk insertable insertable into the holder. The clip includes a base having a retention slot formed thereon for securing the billiard chalk holder. A plate is pivotally attached to the base opposite the chalk holder. A spring is interposed between the base and the plate to maintain the plate in a biased closed position. The retention slot is defined by a lip extending inwardly from a lower edge of the base and forming a groove and an open-faced slot. The chalk holder includes an extension having a post which is insertable into the open-faced slot, and an outwardly extending ridge which is insertable into the groove of the retention slot. A locking mechanism is engageable with the chalk holder and releasably locks the chalk holder in place.

19 Claims, 2 Drawing Sheets

BILLIARDS CHALK ASSEMBLY

BACKGROUND OF THE INVENTION

The present invention relates generally to billiards chalk. More particularly, the present invention relates to an assembly in the form of a clip and holder which releasably holds billiards chalk on an article of clothing or the like of a billiards player.

In the game of billiards, a cue stick is used by a player to hit a cue ball which subsequently strikes other balls to knock one or more balls into the pockets of a billiards table. Billiards players will often chalk the end of their cue stick to promote friction when striking the cue ball and maintain good control over the cue during the shot. The chalk is typically cubed in shape, having an indentation either formed during manufacture or created over time as the hitting end of the cue stick is rubbed into the chalk. As the cue stick is often chalked several times during the course of the game, as frequently as after every shot, there are typically several cubes of chalk dispersed around the playing area, and typically on top of the walls of the billiards table, so as to be accessible during play.

It is not uncommon for a player to have to reposition himself or herself around the table to properly align the next shot. Aside from repositioning to make the shot, the player may often have to walk around the table to obtain a piece of chalk to chalk the cue stick before properly positioning himself or herself for the shot. Billiards is a game of both skill and concentration. The necessity of having to walk around the pool table to obtain chalk can become a distraction. The player may opt to place a cube of chalk in his or her pocket. However, a great deal of chalk dust can be created as the cue stick is repeatedly chalked. Moreover, the chalk is typically a bright color, such as blue, which can stain the pocket lining.

While a player is preparing to hit a shot, it is proper etiquette to not lean on the table, and in fact stand away from the table and to the side of the player preparing to make the shot so as not to distract or interrupt the concentration of the player. The brightly colored chalk randomly placed on the walls of the pool table, can cause a distraction to the player if in the line of sight as the player is aligning the cue ball with the ball to be hit.

Thus, there is a need for a device which enables billiard chalk to be conveniently placed on the person, removed easily for use, and placed back on the person without the inconvenience, mess and distraction previously encountered. The present invention fulfills this need and provides other related advantages.

SUMMARY OF THE INVENTION

The present invention resides in a billiards chalk assembly which can be attached to an article of clothing or the like of a person and retrieved or replaced easily. The assembly generally comprises a clip, a billiards chalk holder which is releasably attached to the clip, and billiard's chalk insertable into the holder.

The clip is comprised of a base having means for securing the billiard chalk holder onto one side thereof. A plate is pivotally attached to an opposite side of the base. The plate is biased in a closed position relative to the base, typically by interposing a spring between the base and plate to maintain the plate in a closed position to form a clip.

The billiards chalk holder retention means preferably comprises a retention slot formed on the base. The retention slot is defined by a lip extending inwardly from a lower edge of the base and forming a groove and an open-faced slot.

The chalk holder comprises a base having walls, typically four walls spaced from one another to compressibly hold a cube of billiard chalk, extending upwardly from the base. An extension projects generally opposite the walls and is configured to securely and releasably mate with the retention slot. More particularly, the extension includes a post which is insertable into the open-face slot, and an outwardly extending ridge which is insertable into the groove of the retention slot.

The clip includes a locking mechanism which locks the chalk holder in place. This locking mechanism comprises an actuator operably linked to a latch which is retractably extendable through an aperture of the base of the clip. The extension of the chalk holder has a depression formed in an end thereof for acceptance of the latch to lock the chalk holder in place on the clip. Pressing the actuator retracts the latch from the depression, allowing the chalk holder to be removed from the clip. After chalking, the holder is slid into the retention slot and locked into place.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
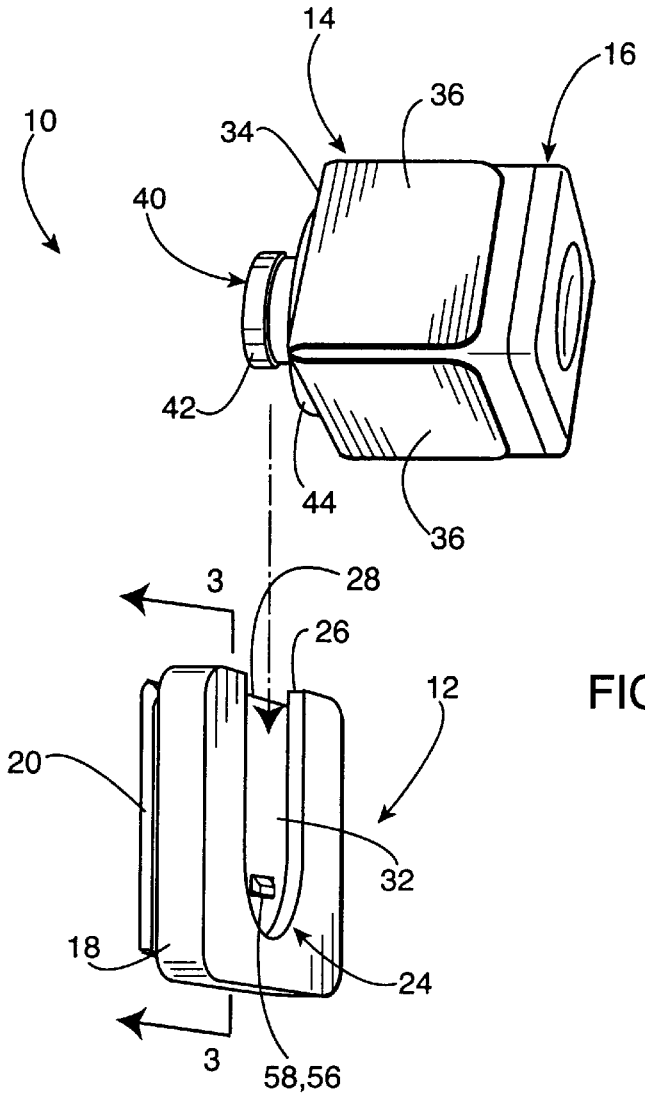
FIG. 1 is a perspective view of a billiards chalk holder with billiards chalk therein, and a clip.
Figure 2:
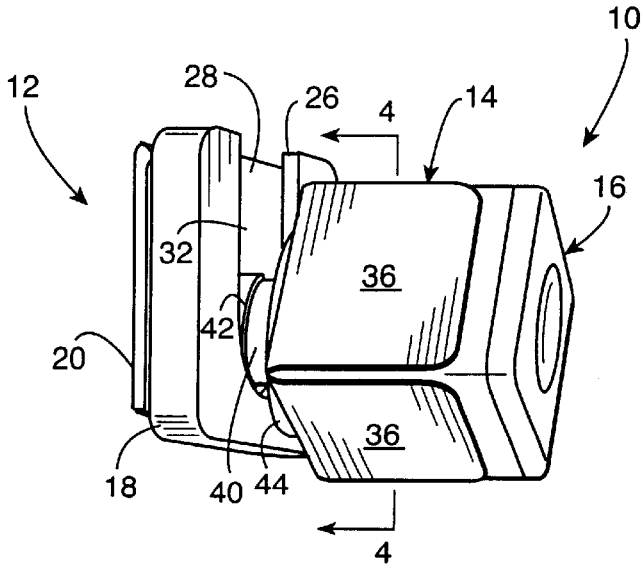
FIG. 2 is a perspective view of the billiards chalk holder of FIG. 1 attached to the clip.
Figure 3:
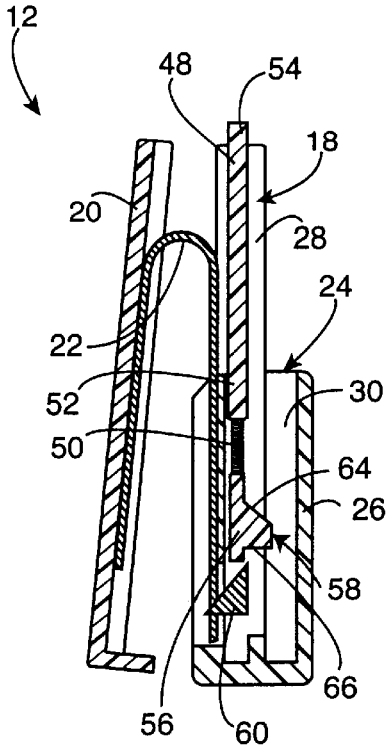
FIG. 3 is a cross-sectional view taken generally along line 3—3 of FIG. 1.
Figure 4:
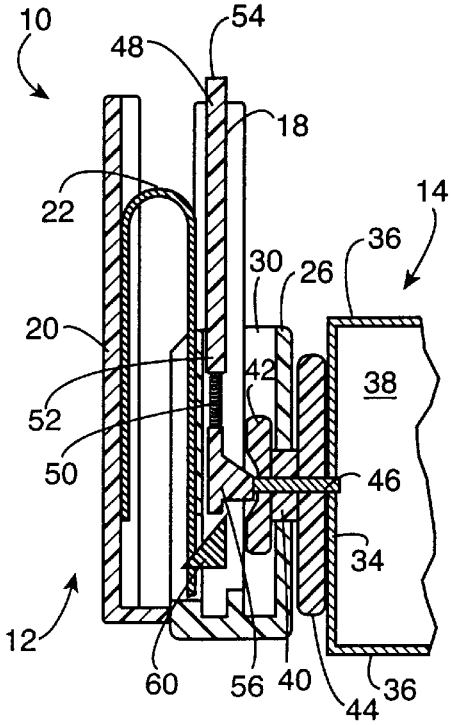
FIG. 4 is a cross-sectional view taken generally along line 4—4 of FIG. 2, illustrating the billiards chalk holder secured within the clip.

As shown in the drawings for purposes of illustration, the present invention is concerned with a billiards chalk assembly, generally referred to in the drawings by the reference number 10. The assembly 10 is generally comprised of a clip 12, a billiards chalk holder 14 and billiards chalk 16 which is insertable into the holder 14. Typically, a leaf spring 22 is interposed between the base 18 and plate 20 to bias the plate 20 is a closed position relative to the base 18, as illustrated in FIG. 4, while enabling the plate 20 to be pivoted in an open position, as illustrated in FIG. 3, allowing the clip 12 to be attached to a belt, pocket or the like.

The base 18 includes means for securing the billiards chalk holder 14 onto one side thereof opposite the plate 20. Typically, such securing means comprises a retention slot 24 formed on the base 18. The retention slot 24 is defined by a lip 26 which extends from the base 18 and is directed inwardly from a lower edge 28 of the base 18 to form a groove 30 and an open-faced slot 32.

The chalk holder 14 is comprised of a base 34 having walls 36 extending upwardly therefrom for securely holding the billiard chalk 16. Preferably, there are four walls 36 slightly spaced from one another and forming a cavity 38 which is slightly smaller than the billiards chalk 16, so that when the billiards chalk 16 is forcibly inserted into the cavity 38, the walls 36 are capable of flexing outwardly to compressibly hold the cube of billiard chalk 16. The billiards chalk holder 14 includes a post 40 which extends from the base 34 generally opposite the walls 36. The post 40 is configured to securely and releasably mate with the retention slot 24 of the clip 12. The post 40 includes an outwardly extending ridge 42 which is insertable into the retention slot groove 30, while the post 40 is inserted into the open-faced slot 32. The post 40 may include a spacer 44 at an end thereof adjacent the base 34 which serves to hold the post 40 and ridge 42 tightly within the retention slot 24 by eliminating any gap between the retention slot lip 26 and billiards chalk holder base 34. The post 40 and spacer 44 may be attached to the chalk holder base 34 in a variety of ways, but is typically held thereto with a rivet 46 or the like which extends through the base 34, spacer 44 and post 40.

Figure 5:
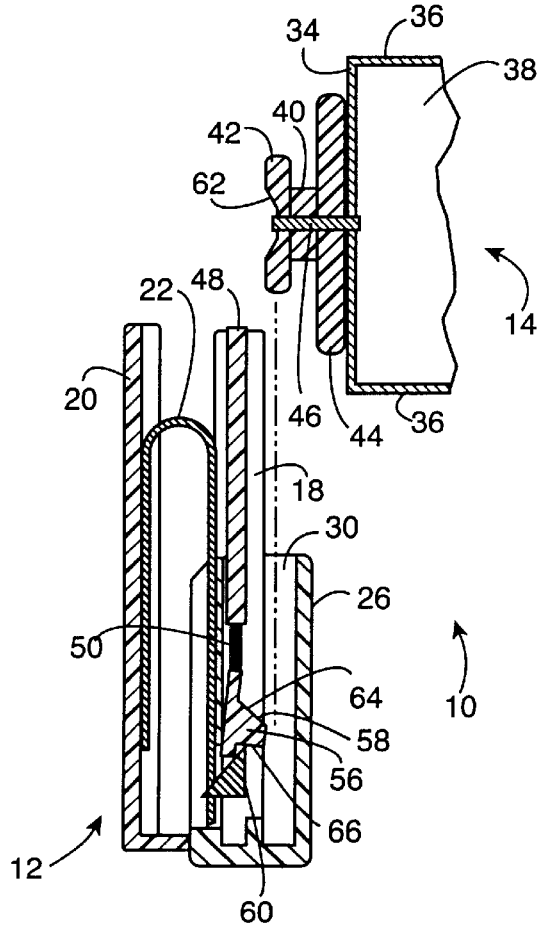
FIG. 5 is a cross-sectional view illustrating the removal of the billiards chalk holder from the clip.

While the billiards chalk holder 14 can be frictionally held within the retention slot 24 of the clip 12, preferably the clip 12 includes a locking mechanism which locks the chalk holder 14 in place. With particular reference to FIGS. 3–5, such a locking mechanism is shown wherein an actuator 48 in the form of a sliding rail attached to a spring 50 at a first end 52 thereof, so that a second end 54 thereof is biased beyond an outer edge of the base 18 of the clip 12. This end 54 acts as a finger-depressable button to actuate the locking mechanism. A latch 56 is attached to the spring 50 generally opposite the actuator slide rail 48. The latch 56 is biased such that it normally extends through an aperture 58 of the clip base 18. However, when end 54 of the actuator 48 is depressed, the spring 50 compresses, causing latch 56 to move, such as by pivoting, and retract from the aperture 58. A stop 60 may be included in order to limit the movement of the latch 56, and retain the bias of actuator 48.

When such a locking mechanism is utilized, the post 40 includes a depression 62 formed at the end thereof which engages latch 56. Preferably, latch 56 includes a beveled portion 64 so that as the post 40 is inserted into the retention slot 24, the latch 56 is pushed down into aperture 58 upon contacting the outer edge of the post 40, and subsequently biased through the base aperture 58 and into the post depression 62 as the depression 62 overlies the base aperture 58. An edge 66 generally opposite the beveled edge 64 of the latch preferably forms a right angle to prevent the chalk holder 14 from being removed from the clip 12 without first actuating the locking mechanism.

To release the chalk holder 14 from the clip 12, the actuator 48 is depressed at end 54, causing the spring 50 to move latch 56 below the upper surface of base 18 so that it retracts into aperture 58. The chalk holder 14 may then be grasped and pulled from the retention slot 24 and away from the clip 12, as illustrated in FIG. 5. When the pressure on actuator end 54 is removed, the actuator 48 is biased again to its original position, with the latch 56 extending through the base aperture 58. The chalk holder 14 can be resecured to the clip 12 by inserting the post and ridge 40 and 42 into the groove 30 and open-faced slot 32 of the retention slot 24, resulting in the chalk holder 14 being locked into placed as described above.

Use of the present invention provides many advantages and benefits as it avoids the potentially distracting and cluttered need to position various cubes of chalk 16 around the periphery of the billiards table as is currently done. Also, the invention provides tremendous convenience to the billiards player as the billiards chalk 16 is always available on the belt or clothing of the player. In this manner, the player can chalk the end of the cue stick at any time regardless of his or her position about the billiards table. As the billiards chalk 16 is held onto the clip 12, the discomfort and staining associated with holding chalk in a pocket is eliminated.

Although a particular embodiment of the invention has been described in detail for purposes of illustration, various modifications may be made without departing from the spirit and scope of the invention. Accordingly, the invention is not to be limited, except as by the appended claims.

What is claimed is:

1. A billiards chalk assembly, comprising:

a clip;

a billiards chalk holder releasably attached to the clip; and billiards chalk insertable into the holder;

wherein the clip includes a locking mechanism which locks the chalk holder in place, and wherein the locking mechanism includes an actuator operably linked to a latch which is retractably extendible through an aperture of a base of the clip and engageable with the chalk holder.

2. The assembly of claim 1, wherein the clip includes a base having means for securing the billiard chalk holder onto one side thereof, and a plate pivotally attached to the base on an opposite side thereof.

3. The assembly of claim 2, wherein the plate is biased in a closed position relative to the base.

4. The assembly of claim 3, including a spring interposed between the base and plate to maintain the plate in a closed position.

5. The assembly of claim 2, wherein the securing means comprises a retention slot formed on the base.

6. The assembly of claim 5, wherein the chalk holder includes a base having walls extending upwardly therefrom for securely holding billiard chalk, and an extension projecting generally opposite the walls and configured to securely and releasably mate with the retention slot.

7. The assembly of claim 6, wherein four walls spaced from one another extend from the base to compressibly hold a cube of billiard chalk.

8. The assembly of claim 5, wherein the retention slot is defined by a lip extending inwardly from a lower edge of the base and forming a groove and an open-faced slot.

9. The assembly of claim 8, wherein the chalk holder extension includes a post which is insertable into the open-faced slot.

10. The assembly of claim 9, wherein the post includes an outwardly extending ridge which is insertable into the groove of the retention slot.

11. The assembly of claim 1, wherein the chalk holder includes an extension having a depression formed in an end thereof for acceptance of the latch to lock the chalk holder in place on the clip.

12. A billiards chalk assembly, comprising:

a clip including a base having a retention slot formed on a side thereof, and a plate pivotally attached to the base on an opposite side thereof; and a billiards chalk holder including a base having walls extending upwardly therefrom for securely holding billiard chalk, and an extension projecting generally opposite the walls and configured to securely and releasably mate with the retention slot;

wherein the clip includes a locking mechanism which locks the chalk holder in place, and wherein the locking mechanism includes an actuator operably linked to a latch which is retractably extendible through an aperture of a base of the clip and engageable with the chalk holder.

13. The assembly of claim 12, including a spring interposed between the base and the plate to bias the plate in a closed position relative to the base.

14. The assembly of claim 12, wherein four walls spaced from one another extend from the base to compressibly hold a cube of billiard chalk.

15. The assembly of claim 12, wherein the retention slot is defined by a lip extending inwardly from a lower edge of the base and forming a groove and an open-faced slot.

16. The assembly of claim 15, wherein the chalk holder extension includes a post which is insertable into the open-faced slot, and an outwardly extending ridge which is insertable into the groove of the retention slot.

17. The assembly of claim 12, wherein the chalk holder includes an extension having a depression formed in an end thereof for acceptance of the latch to lock the chalk holder in place on the clip.

18. A billiards chalk assembly, comprising:

a clip including a base having a plate pivotally attached to the base on a side thereof, and a retention slot formed on an opposite side thereof and defined by a lip extending inwardly from a lower edge of the base and forming a groove and an open-faced slot;

a spring interposed between the base and the plate to bias the plate in a closed position relative to the base; and a billiards chalk holder including a base having four walls spaced from one another and extending from the base to compressibly hold a cube of billiard chalk, and an extension projecting generally opposite the walls and including a post which is insertable into the open-faced slot, and an outwardly extending ridge which is insertable into the groove of the retention slot;

wherein the clip includes a locking mechanism which releasably locks the chalk holder in place, and wherein the locking mechanism includes an actuator operably linked to a latch which is retractably extendible through an aperture of a base of the clip and engageable with the chalk holder.

19. The assembly of claim 18, wherein the chalk holder includes an extension having a depression formed in an end thereof for acceptance of the latch to lock the chalk holder in place on the clip.

* * * * *